US008424865B2

(12) United States Patent
Eguchi et al.

(10) Patent No.: US 8,424,865 B2
(45) Date of Patent: Apr. 23, 2013

(54) SHEET FEEDING DEVICE AND IMAGE FORMING APPARATUS INCORPORATING SAME

(75) Inventors: Yosuke Eguchi, Tokyo (JP); Manabu Nonaka, Kanagawa (JP); Yoshikuni Ishikawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/137,471

(22) Filed: Aug. 18, 2011

(65) Prior Publication Data

US 2012/0061903 A1 Mar. 15, 2012

(30) Foreign Application Priority Data

Sep. 10, 2010 (JP) ..... 2010-203548

(51) Int. Cl.
*B65H 3/16* (2006.01)

(52) U.S. Cl.
USPC ..... 271/18.1; 271/3.21; 271/4.05; 271/18.2; 271/34

(58) Field of Classification Search ..... 271/3.02, 271/3.21, 4.05, 34, 18.1, 18.2, 193
See application file for complete search history.

(56) References Cited

U.S. PATENT DOCUMENTS 5,106,260 A * 4/1992 Obrecht ..... 414/796.6
6,244,586 B1 * 6/2001 Gauger et al. ..... 271/12
7,527,257 B2 * 5/2009 Trilk et al. ..... 271/104
2011/0024971 A1 * 2/2011 Toyooka et al. ..... 271/11

FOREIGN PATENT DOCUMENTS

JP 09067033 A * 3/1997
JP 3159727 B2 4/2001
JP 2003-160248 A 6/2003

OTHER PUBLICATIONS

English language abstract for JP-04-251041 which corresponds to JP-3159727-B2.

* cited by examiner

*Primary Examiner* — Michael McCullough
*Assistant Examiner* — Howard Sanders
(74) *Attorney, Agent, or Firm* — Harness, Dickey & Pierce P.L.C.

(57) ABSTRACT

A sheet feeding device that is incorporatable in an image forming apparatus includes an endless belt disposed facing an upper surface of a sheet stack to convey sheets of the sheet stack forward in a first moving direction of a surface thereof, an attraction unit to attract an uppermost sheet of the sheet stack to the endless belt, a contact and separation unit to contact and separate the endless belt relative to the sheet stack, and a controller to cause the endless belt to contact or substantially contact the upper surface of the sheet stack to attract the uppermost sheet to the endless belt, perform a pre-separation operation in which the endless belt moves in a reverse direction that is opposite the sheet conveyance direction, and then perform a separating operation in which the endless belt separates from the sheet stack.

12 Claims, 10 Drawing Sheets

SHEET FEEDING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2010-203548, filed on Sep. 10, 2010 in the Japan Patent Office, the entire disclosure of which is hereby incorporated herein by reference.

FIELD OF THE INVENTION

Embodiments of the present invention relate to a sheet feeding device and an image forming apparatus incorporating the sheet feeding device.

BACKGROUND OF THE INVENTION

In related-art image forming apparatuses that form an image on a sheet of recording media according to image data, a sheet feeding device incorporated load a plurality of sheets and feed the sheets one by one toward an image forming device. The image forming device then forms an image on a sheet supplied from the sheet feeding device. Such a device encounters the problem of how to cleanly separate the sheets for forwarding to the image forming part, for which various solutions have been advanced.

As one approach, an electrostatic sheet feeding method to separate and feed a sheet electrostatically has been proposed, for example, in Japanese Patent No. 3159727. In the electrostatic sheet feeding method, a dielectric endless belt is wound around multiple rollers and a charging member applies alternating electrical charges to the surface of the dielectric endless belt. The thus-charged dielectric endless belt then contacts or nearly contacts a stack of sheets so as to attract an uppermost sheet of the stack of sheets thereto. After a predetermined period of time, the dielectric endless belt is physically separated from the stack of sheets and then is rotated to feed and convey the uppermost sheet attracted to the dielectric endless belt forward.

When the leading edge of a sheet of the stack of sheets is curled or burred by cutting, the sheet is likely to separate from the dielectric endless belt too easily, which can cause sheet conveyance failure. More specifically, the attractive force of the dielectric endless belt is storing with respect to a force exerted in a sheet conveyance direction but weak with respect to a force exerted in a vertical direction perpendicular to the belt surface. With the leading edge of the stack of sheets curled or burred by cutting, the adhesive force exerted at the leading edge of the sheet in the vertical direction perpendicular to the belt surface may increase. Therefore, when the dielectric endless belt is separated from the stack of sheets, the uppermost sheet can separate too easily from the dielectric endless belt due to the relative weakness of the adhesive force at the leading edge of the stack of sheets, therefore producing sheet conveyance failure.

Similar problems can occur when using an air-driven sheet separation method, in which air is blown from a direction opposite an edge surface of a moving direction of a surface of a stack of sheets to separate an uppermost sheet from the other sheets and then attract the uppermost sheet to the dielectric endless belt.

As another approach, Japanese Patent Application Publication No. JP 2003-160248 (JP-2003-160248-A1) discloses a sheet feeding device that includes a first attraction belt disposed upstream from the leading edge of the stack of sheet in the sheet conveyance direction and a second attraction belt disposed facing the leading edge of the stack of sheets and having an attractive force stronger than that of the first attraction belt. Since the second attraction belt having a stronger attractive force than the first attraction belt attracts the leading edge of the sheet, even when the attractive force between the sheets at the leading edge thereof is strong due to curl or burr formed by cutting at the leading edge of sheets of the stack, the leading edge of the uppermost sheet can be separated from the stack of sheets.

However, in JP-2003-160248-A1, an attraction unit including the second attraction belt (e.g., a unit composed of the second attraction belt, multiple tension rollers around which the second attraction belt is wound with tension, an applicator to apply an attractive force to the second attraction belt, and a contact and separation drive unit to drive the second attraction belt to contact or separate from the stack of sheets) is disposed separately from an attraction unit including the first attraction belt. Accordingly, installation of separate attraction units or components can increase costs of an image forming apparatus.

BRIEF SUMMARY OF THE INVENTION

The present invention describes a novel sheet feeding device. In one example, a novel sheet feeding device includes an endless belt disposed facing an upper surface of a sheet stack to convey sheets of the sheet stack forward in a first moving direction of a surface thereof, an attraction unit to attract an uppermost sheet of the sheet stack to the endless belt, a contact and separation unit to contact and separate the endless belt relative to the sheet stack, and a controller to cause the endless belt to contact or substantially contact the upper surface of the sheet stack to attract the uppermost sheet to the endless belt, move the endless belt with the uppermost sheet attracted thereto in reverse in a second moving direction opposite the first moving direction, and separate the endless belt from the sheet stack.

The endless belt may include a sheet attraction surface portion arranged facing the upper surface of the sheet stack to attract the uppermost sheet thereto. A downstream end of the sheet attraction surface portion of the endless belt in a sheet conveyance direction may be located upstream from a leading edge of the sheet stack in the sheet conveyance direction.

The controller may cause the endless belt to move in the second moving direction until a leading edge of the uppermost sheet attracted to the endless belt comes to a point upstream from the downstream end of the sheet attraction surface portion of the endless belt in the sheet conveyance direction.

The above-described sheet feeding device may further include a curl detector facing a trailing edge of the sheet stack and operatively connected to the controller to detect an amount of curl of the sheet stack. The controller may determine, based on detection results obtained by the curl detector, whether or not the endless belt with the uppermost sheet attracted thereto is moved in the second moving direction.

When the amount of curl of the sheet equals or exceeds a threshold amount, the controller may cause the endless belt to move in the second moving direction multiple times.

A width of the endless belt may be greater than a maximum width of the sheet stack that can be accommodated in a sheet container.

The attraction unit may apply an alternating electrical charge to the endless belt.

Further in one example, a novel image forming apparatus includes an image forming unit to form an image on a recording medium, and the above-described sheet feeding device.

Further in one example, a novel sheet conveying method includes supplying an alternating charge to an endless belt, moving a contact and separation unit upward for lifting a bottom plate, detecting an uppermost sheet upon or immediately before contact of the uppermost sheet to the endless belt as the contact and separation unit moves upward, stopping the contact and separation unit, holding the endless belt in contact with the uppermost sheet until a predetermined period of time elapses, rotating the endless belt in reverse to convey the uppermost sheet in a reverse direction opposite a sheet conveyance direction, separating the uppermost sheet from the endless belt, and conveying the uppermost sheet attracted to the endless belt further forward.

The rotating step may include comparing an amount of curl of the uppermost sheet with a first threshold, and rotating the endless belt in the reverse direction once when the amount of curl of the uppermost sheet equals or exceeds the first threshold.

The comparing step may include comparing the amount of curl of the uppermost sheet with a second threshold, and rotating the endless belt in the reverse direction for multiple times when the amount of curl of the uppermost sheet equals or exceeds the second threshold.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
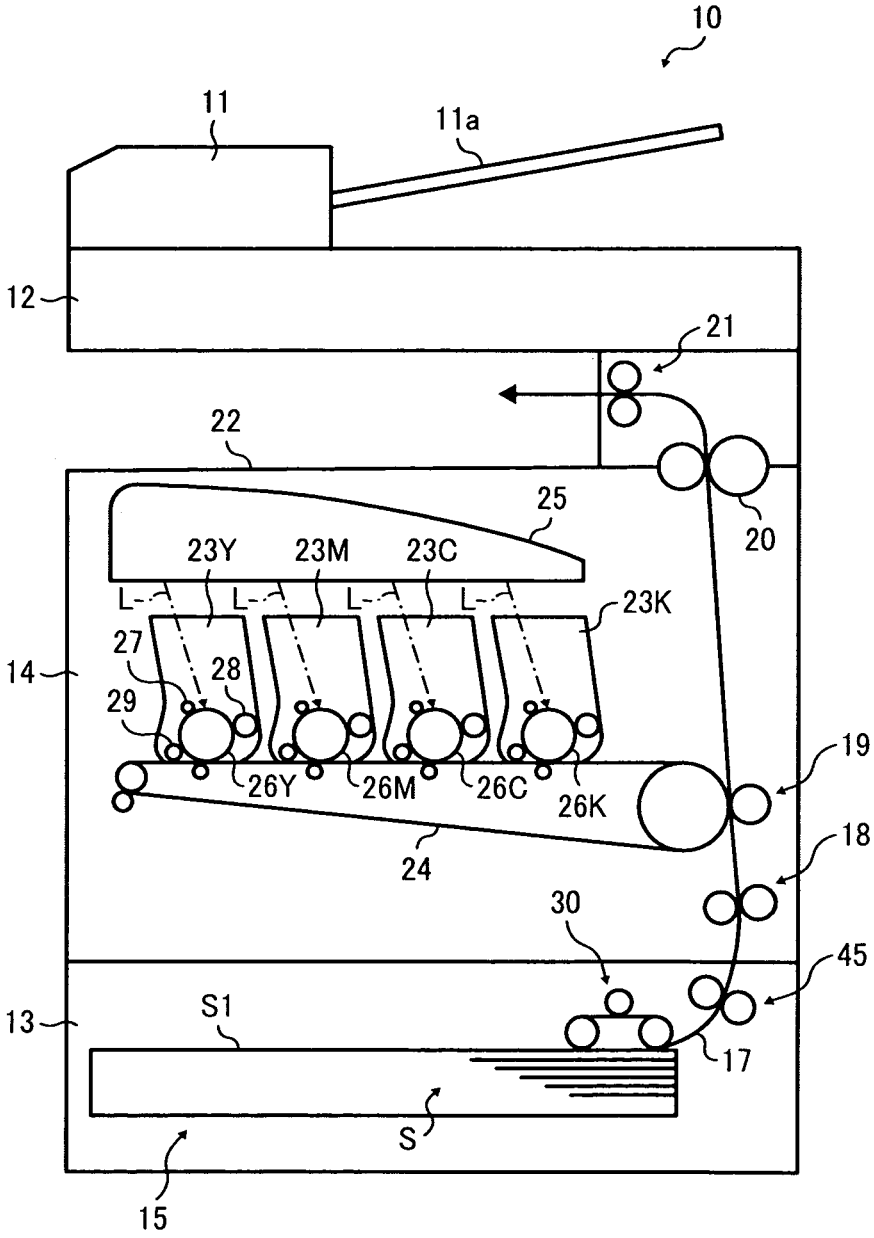
FIG. 1 illustrates a schematic configuration of a copier according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

FIG. 1 is a schematic view of an image forming apparatus 10 according to an embodiment of the present invention.

As illustrated in FIG. 1, an image forming apparatus 10 may be a copier, a facsimile machine, a printer, a multifunction printer having at least one of copying, printing, scanning, plotter, and facsimile functions, or the like. The image forming apparatus 10 may form an image by an electrophotographic method, an inkjet method, or any other suitable method. According to this embodiment, the image forming apparatus 10 functions as a copier 10 for forming an image on a recording medium by the electrophotographic method. Hereinafter, the image forming apparatus 10 is also referred to as the copier 10.

Figure 3:
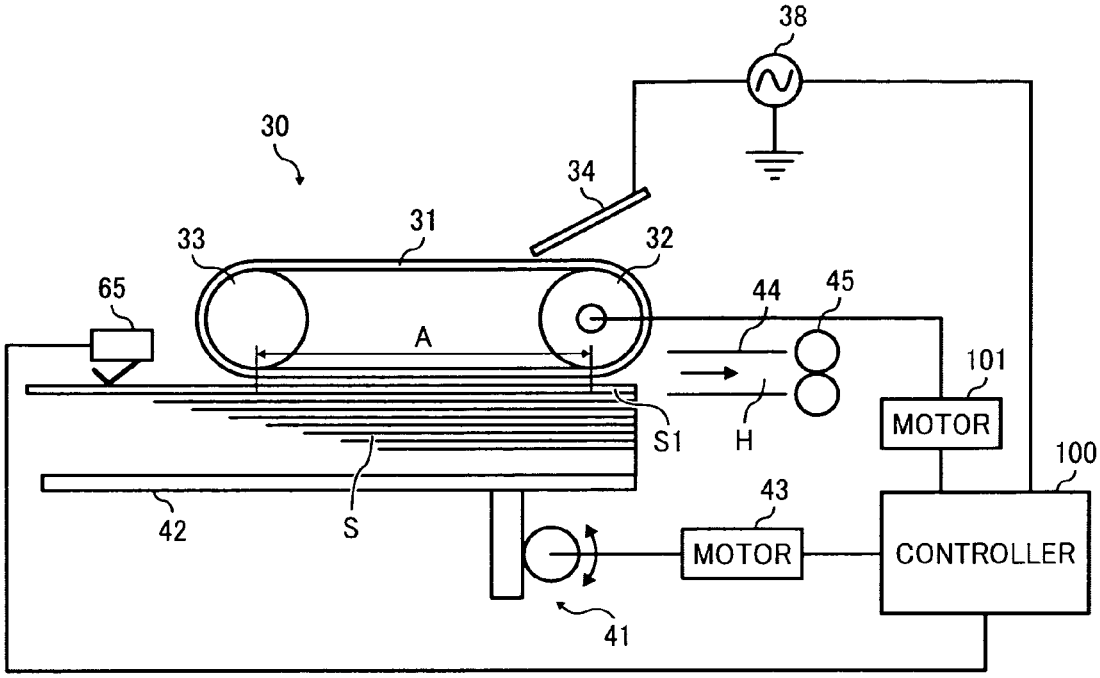
FIG. 3 illustrates a schematic diagram of a sheet feeding device of the sheet supplying device of FIG. 2.

In FIG. 3, the copier 10 includes an automatic document feeder (ADF) 11, a document reader 12, a sheet supplying device 13, an image forming device 14, a pair of registration rollers 18, a transfer roller 19, a fixing unit 20, a pair of sheet discharging rollers 21, and a sheet discharging tray 22.

The ADF 11 is mounted on the document reader 12. The ADF 11 includes a document sheet tray 11*a* to hold a document stack thereon. The ADF 11 separates each document one by one from the document stack on the document sheet tray 11*a* to automatically feed the separated document to the document reader 12.

The document reader 12 reads image data of the document fed from the ADF 11 on a contact glass mounted thereon.

The sheet supplying device 13 is disposed below the image forming device 14. The sheet supplying device 13 accommodates a sheet stack S or recording media therein to supply an uppermost sheet S1 that is picked up from the sheet stack S, to the image forming device 14.

The image forming device 14 forms an image on the uppermost sheet S1 supplied by the sheet supplying device 13 according to the image data read in the document reader 12.

According to this embodiment, the image forming device 14 can separate from the sheet supplying device 13 that supplies the uppermost sheet 51 to the image forming device 14.

The image forming device 14 includes four image forming units 23 (specifically, an image forming unit 23Y for forming yellow toner image, an image forming unit 23C for forming cyan toner image, an image forming unit 23M for forming magenta toner image, and an image forming unit 23K for forming black toner image), the intermediate transfer belt 24 that serves as an intermediate transfer member, and an optical writing device 25.

The optical writing device 25 receives color separation image data transmitted from an external device such as a personal computer or a word processor and image data of original documents read by the document reader 12 and converts the image data to a signal for light source driving. Accordingly, the optical writing device 25 drives a semiconductor laser in each laser light source unit, and emits light beams L.

The image forming units 23Y, 23C, 23M, and 23K form respective single-color toner images different from each other. The image forming units 23Y, 23C, 23M, and 23K include a photoconductor 26 (specifically, a photoconductor 23Y for carrying yellow toner image thereon, a photoconductor 26C for carrying cyan toner image thereon, a photoconductor 26M for carrying magenta toner image thereon, and a photoconductor 26K for carrying black toner image thereon), and image forming components disposed around the photoconductor 26. The image forming components included in each of the image forming units 23Y, 23C, 23M, and 23K shown in FIG. 1 are a charging unit 27, a developing unit 28, and a cleaning unit 29.

The photoconductor 26 is a cylindrical image carrier that is rotated by a drive source, not illustrated in FIG. 3. The photoconductor 26 has a photoconductive layer as an outer surface thereof.

The charging unit 27 is disposed contacting the photoconductor 26 to uniformly charge the outer surface of the photoconductor 26. The charging unit 27 according to this embodiment employs a contact-type charging method in which a charging member such as a charging roller uniformly charges the outer surface of the photoconductor 26 by contacting or nearly contacting the outer surface of the photoconductor 26. However, a charging method is not limited thereto.

The light beams L or light spots emitted by the optical writing device 25 irradiate the outer surface of the photoconductor 26 to optically write an electrostatic latent image according to image data.

The developing unit 28 supplies toner to the outer surface of the photoconductor 26 to develop the electrostatic latent image into a visible toner image. In this embodiment, a non-contact type developing unit that does not directly contact the photoconductor 26 is employed.

The cleaning unit 29 is a brush-contact-type unit in which a brush member of the cleaning unit 29 is disposed slidably contacting the outer surface of the photoconductor 26 to remove residual toner remaining on the outer surface of the photoconductor 26.

The intermediate transfer belt 24 is an endless belt member including a resin film or a rubber material. The toner images formed on the respective outer surfaces of the photoconductors 26Y, 26C, 26M, and 26K are transferred subsequently from the photoconductor 26 onto a surface of the intermediate transfer belt 24 to form a composite color toner image before being further transferred onto the uppermost sheet S1 at the secondary transfer nip area formed by the transfer roller 19.

The uppermost sheet S1 having the composite color toner image thereon is conveyed to the fixing unit 20 to be fixed to the uppermost sheet S1 by application of heat and pressure, and is finally discharged to the sheet discharging tray 22 via the pair of sheet discharging rollers 21.

Figure 2:
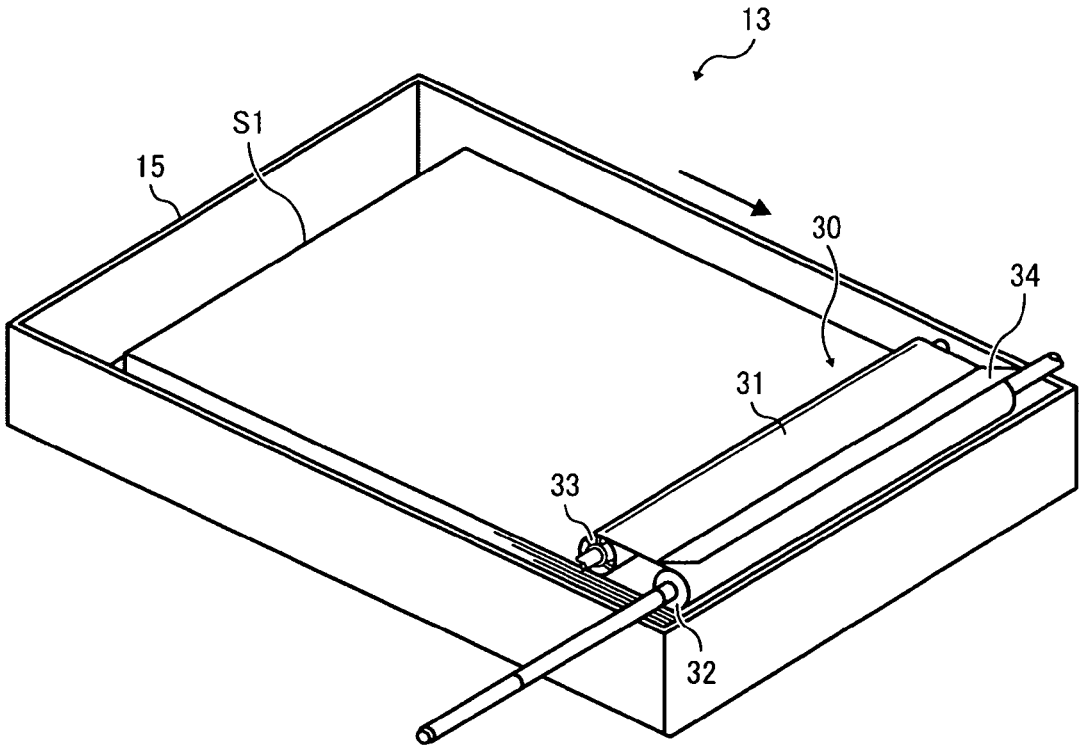
FIG. 2 illustrates a perspective view of a schematic configuration of a sheet supplying device of the copier of FIG. 1.

FIG. 2 is a perspective view of the sheet supplying device 13 incorporated in the copier 10.

As illustrated in FIG. 2, the sheet supplying device 13 includes a sheet feeding cassette 15 and a sheet feeding device 30. The sheet feeding cassette 15 serves as a sheet container and loads the sheet stack S therein, and the uppermost sheet S1 placed on top of the sheet stack S is attracted to the sheet feeding device 30 and then fed and conveyed further forward.

The uppermost sheet S1 separated and fed by the sheet feeding device 30 travels in a sheet conveyance path 17 (see FIG. 1) that passes through the nip area formed between the pair of registration rollers 18 and then the secondary transfer nip area formed between the transfer roller 19 and a roller facing the transfer roller 19 with the intermediate transfer belt 24 interposed therebetween.

As illustrated in FIG. 2, the sheet feeding device 30 is disposed above the sheet feeding cassette 15. The pair of registration rollers 18 conveys the uppermost sheet S1 at a predetermined time to a predetermined transfer position formed by the transfer roller 19. A width along an axial direction of the sheet feeding device 30 is wider or longer than that of any sheet that can be loaded in the sheet feeding cassette 15 and is disposed in the vicinity of the latitudinal center in the width direction of the loadable sheet.

Further, the sheet feeding device 30 includes one attraction belt in the present embodiment, however, the number of the attraction belt is not limited thereto. For example, two or more attraction belts can be disposed along the width of any loadable sheet, and therefore an entire length of the sheet feeding device may be longer than the width of loadable sheets.

Figure 4:
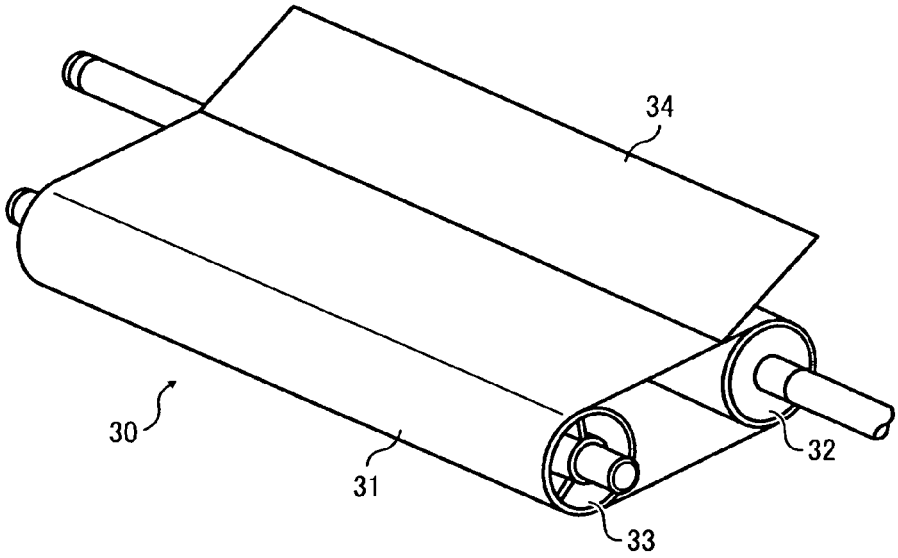
FIG. 4 is a perspective view of a main configuration of the sheet feeding device of FIG. 3.

FIG. 3 is a diagram illustrating the sheet feeding device 30, and FIG. 4 is a diagram illustrating units and components included in the sheet feeding device 30.

As illustrated in FIG. 3, the sheet feeding device 30 according to this embodiment includes an attraction belt 31 serving as a dielectric endless belt that is wound around a drive roller 32 that serves as a first tension roller and a driven roller 33 that serves as a second tension roller. The attraction belt 31 has a multilayer construction that includes a front layer (e.g., a front layer 31*a* illustrated in FIG. 6) having a resistivity of about $10^8$ Ω·cm or greater (for example, a polyethylene terephthalate film having a thickness of about 100 μm) and a back layer (e.g., a back layer 31*b* illustrated in FIG. 6) having a resistivity of about $10^6$ Ω·cm or smaller to maintain a good charging state. The attraction belt 31 having the multilayer construction can use the back layer as a grounded opposite charging member. Further, a charging member 34 to apply electric charge to the attraction belt 31 can be disposed at any position facing the front layer 31*a* of the attraction belt 31. An outer surface of the drive roller 32 includes a conductive rubber layer having a resistivity of about $10^6$ Ω·cm. The drive roller 33 includes metal material. The drive roller 32 and the drive roller 33 are electrically grounded.

The drive roller 32 has a small diameter that is suitable for separating the uppermost sheet S1 from the attraction belt 31 using a curvature. Namely, the large curvature caused by the small diameter of the drive roller 32 separates the uppermost sheet S1 attracted by the attraction belt 31 from the attraction belt 31 contacting the drive roller 32, and the attraction belt 32 rotated by the drive roller 32 can feed the separated uppermost sheet S1 toward a conveyance pathway H that is defined by a pair of guide members 44 provided downstream from the drive roller 32 in the sheet conveyance direction indicated by arrow shown in FIG. 3.

Further, the drive roller 32 is configured to intermittently be driven by the drive motor 101 via an electro-magnetic clutch in accordance with a sheet feeding signal. The drive motor 101 corresponds to a stepping motor or any motor that can rotate in a forward direction and a reverse direction. In this embodiment, a sheet attraction surface portion A of the attraction belt 31 to which the uppermost sheet S1 of the sheet stack S is attracted is located upstream from the leading edge of the sheet stack S in the sheet conveyance direction.

A blade-shaped charging member 34 is disposed in contact with the outer surface of the attraction belt 31 to charge the outer surface of the attraction belt 31. The charging member 34 is an electrode extending along the width of the attraction belt 31 and connected to an alternating-current power supply 38 that generates an alternating-current voltage. The charging member 34 having a shape of a blade can form alternating charges at smaller intervals, and therefore, even though the attraction belt 31 has small waves formed thereon, a reliable charging operation can be performed.

Figure 5:
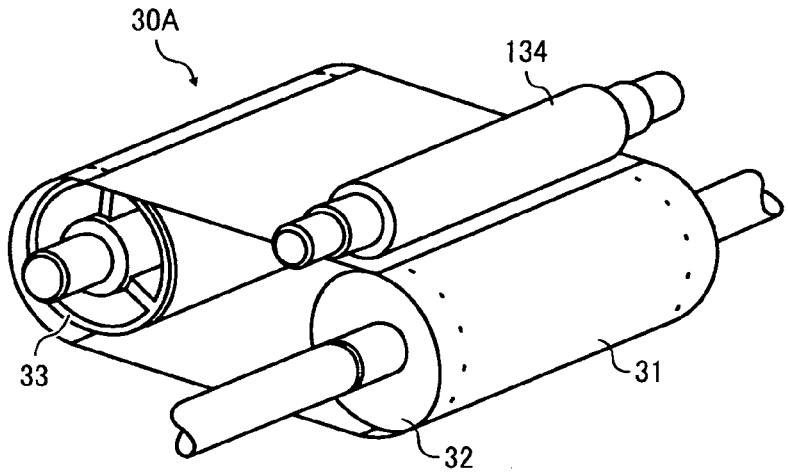
FIG. 5 is a perspective view of an example of another configuration of a charging member of the sheet feeding device of FIG. 3.

In this embodiment, the blade-type charging member 34 is employed as a sheet attraction unit that applies electric charge and functions as an electric potential pattern forming unit, but is not limited thereto. For example, as illustrated in FIG. 5, a modified sheet feeding device 30A can employ a roller-type charging member 134 serving as a sheet attraction unit that functions as the electric potential pattern forming unit.

Figure 6:
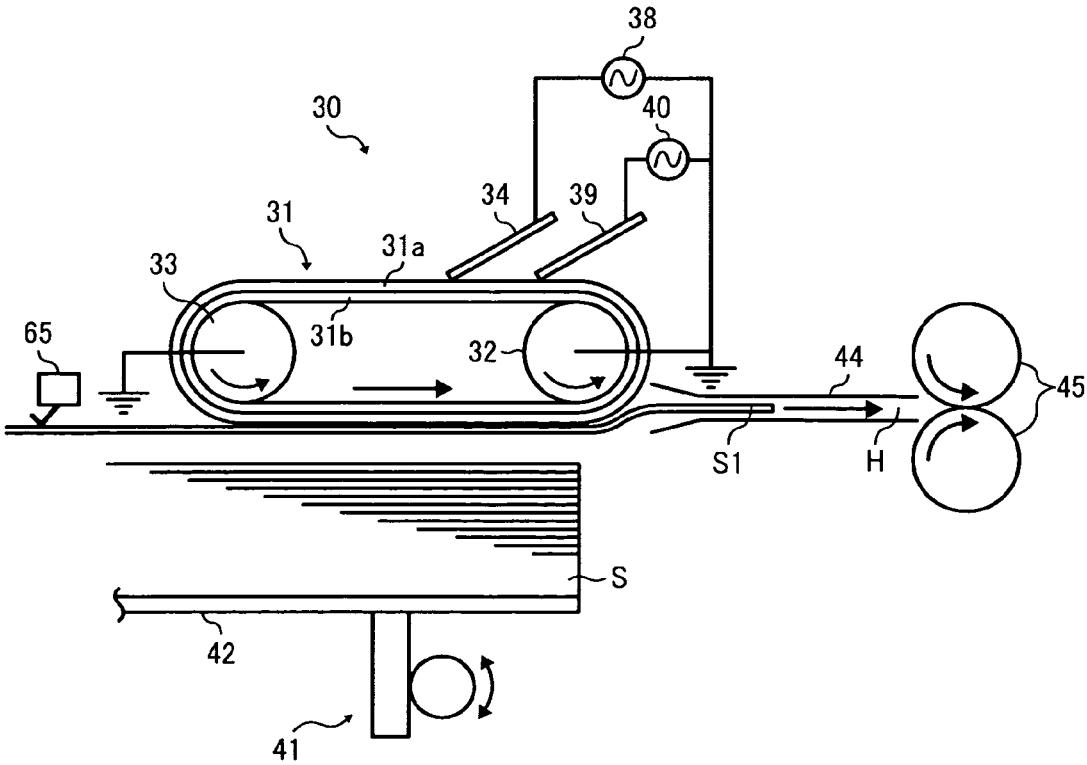
FIG. 6 is a front view of an example of yet another configuration of an electric discharging unit of the sheet feeding device of FIG. 3.

Further, as illustrated in FIG. 6, a discharging member 39 that is connected to an electric discharging power supply 40 that serves as an alternating current power supply can be disposed upstream from the charging member 34 in the direction of rotation of the attraction belt 31 and downstream from the separation portion of the sheet stack S and the attraction belt 31 so as to contact or nearly contact the attraction belt 31.

The sheet feeding cassette 15 includes a bottom plate 42 that loads the sheet stack S including accumulated sheets. A sheet push-up unit 41 employing a rack and a pinion is disposed between the bottom plate 42 and the bottom surface of the sheet feeding cassette 15. The sheet push-up unit 41 serves as a contact and separation unit. Further, the sheet feeding cassette 15 includes a sheet detecting unit 65 that serves as a sheet detector to detect whether or not the uppermost sheet S1 of the sheet stack S has reached a predetermined position.

A controller 100 is connected to a motor 43 that serves as a drive source of the sheet push-up unit 41, a drive motor 101 that drives the drive roller 32, and the sheet detecting unit 65. The controller 100 can be provided in the sheet feeding device 30 individually or in a different control unit to control the copier 10 including the functions of the sheet feeding device 30.

Figure 7:
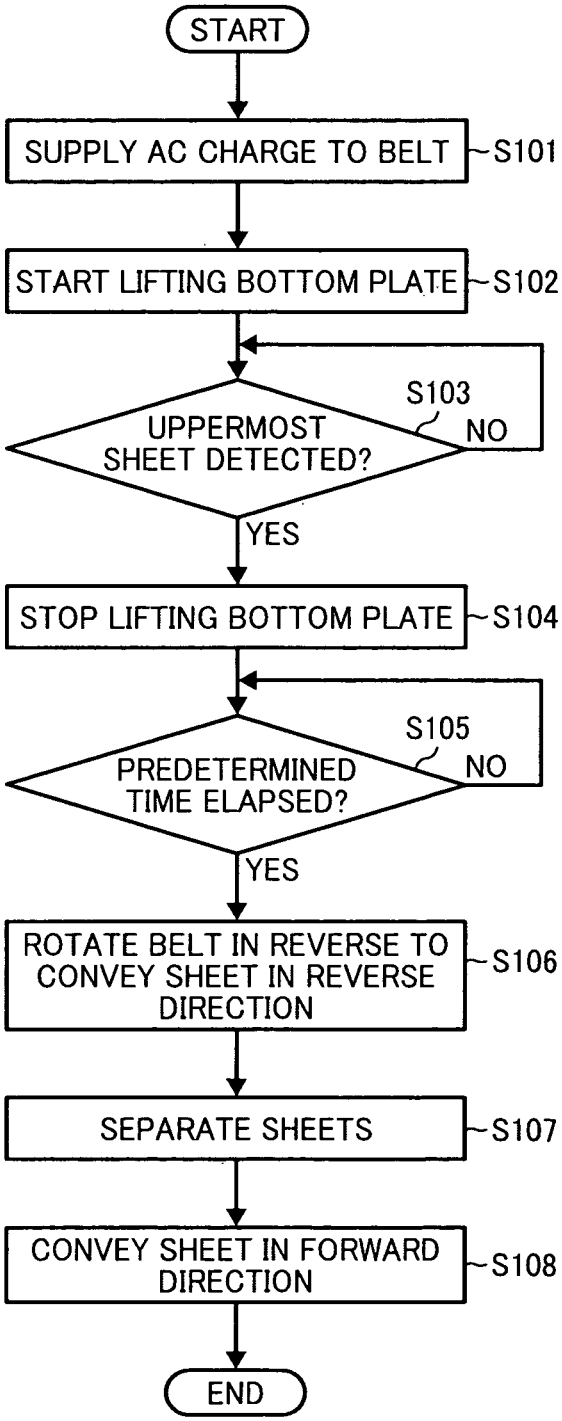
FIG. 7 is a flowchart for a sheet conveying operation performed by the sheet feeding device of FIG. 3.

Next, a description is given of a sheet conveying operation using the sheet feeding device 30 according to an embodiment of the present invention. FIG. 7 illustrates a flowchart of the sheet conveying operation.

Generally, the bottom plate 42 is located at a lower position, and the attraction belt 31 is separated from the upper surface of the sheet stack S. Upon receipt of the sheet feeding signal, an electromagnetic clutch is turned on, and then the drive roller 32 is driven to rotate the attraction belt 31 in a loop form in step S101. Then, the AC power supply 38 supplies an alternating-current (AC) voltage to the endlessly rotating attraction belt 31 via the charging member 34. By so doing, the outer circumferential surface of the attraction belt 31 is charged with charging patterns that alternate with a pitch that varies according to the frequency of the AC power supply 38 and the rotation speed of the attraction belt 31. Preferably, the pitch is set at approximately 5 mm to approximately 15 mm. Instead of the AC voltage, the AC power supply 38 may also apply a direct current (DC) voltage in which high and low potentials alternate. In the present embodiment, the outer circumferential surface of the attraction belt 31 is supplied with a voltage having an amplitude of from approximately 3 kv (kilovolts) to approximately 4 kv (from ±1.5 to ±2.0).

After step S101, the controller 100 causes the motor 43 to move up the sheet push-up unit 41 having the rack and pinion upward to lift up the bottom plate 42, in step S102. As the bottom plate 42 goes up, the controller 100 determines whether or not the sheet detecting unit 65 detects the upper surface of the uppermost sheet S1 upon or immediately before contact of the uppermost sheet S1 of the sheet stack S to the attraction belt 31, in step S103.

When the sheet detecting unit 65 detects the upper surface of the uppermost sheet S1, the result of step S103 is YES and the controller 100 causes the motor 43 to stop the sheet push-up unit 41 to stop the movement of the bottom plate 42, in step S104.

When the sheet detecting unit 65 does not detect the upper surface of the uppermost sheet S1, the result of step S103 is NO and the process of step S103 is repeated until the sheet detecting unit 65 detects the upper surface of the uppermost sheet S1.

As described above, when the attraction belt 31 contacts the uppermost sheet S1, a non-uniform electrical field formed by the electric potential pattern on the surface of the attraction belt 31 generates Maxwell stress, acting on the sheets of the sheet stack S that functions as a dielectric material. Accordingly, the uppermost sheet S1 of the sheet stack S is attracted to and held on the attraction belt 31.

With the attraction belt 31 held in contact with the uppermost sheet S1 of the sheet stack S, the attraction belt 31 waits until a predetermined period of time elapses, in step S105. The force of attraction or the attractive force generated by the electric potential pattern to the attraction belt 31 is exerted on the uppermost sheet S1, the second uppermost sheet, and, in some cases, any subsequent sheets for a predetermined period of time from the moment the attraction belt 31 contacts the sheet stack S before being picked up from the sheet stack S. However, after the predetermined period of time has elapsed, the attractive force acts on the uppermost sheet S1 only. Namely, the attractive force does not act on the second uppermost sheet and any other subsequent sheets. Therefore, by waiting for the predetermined period of time to elapse from when the uppermost sheet S1 is attracted to the attraction belt 31, it is possible to separate only the uppermost sheet S1 from the other sheets of the sheet stack S.

After the attraction belt 31 has been held in contact with the uppermost sheet S1 of the sheet stack S for a predetermined period of time, the result of step S105 is YES, and the sheet feeding device 30 performs a pre-separation operation, in step S106. Specifically, in the pre-separation operation, the attraction belt 31 is rotated in reverse to convey the uppermost sheet S1 in a reverse direction that is opposite the sheet conveyance direction so as to separate the uppermost sheet S1 from the other sheets of the sheet stack S. At this time, only the uppermost sheet S1 is attracted to the attraction belt 31, and therefore is conveyed by the attraction belt 31 in the reverse direction, as illustrated in FIG. 8.

Figure 8:
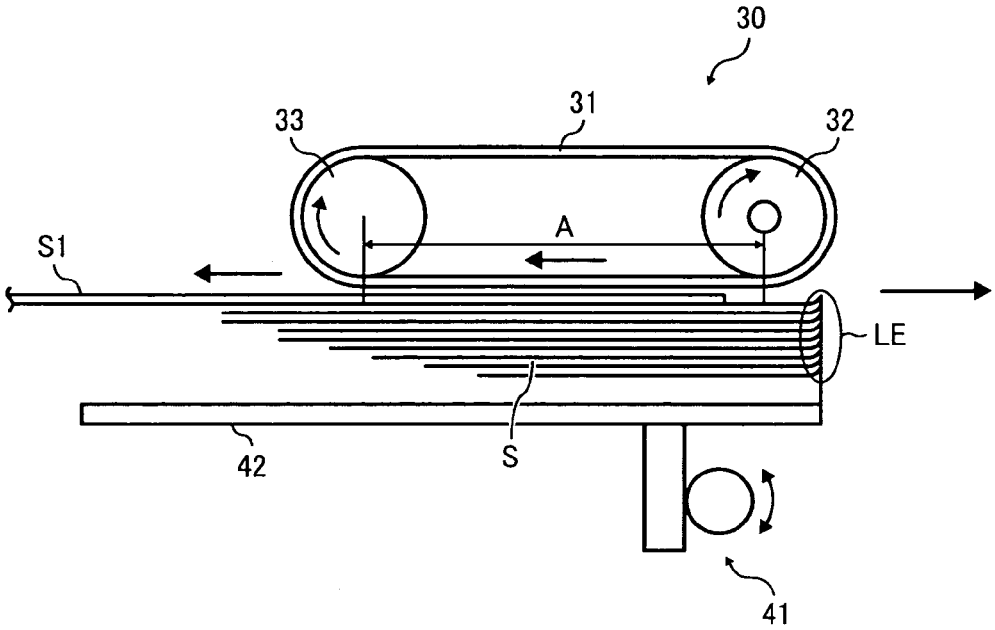
FIG. 8 is a drawing for explaining a pre-separation operation of the sheet feeding device of FIG. 3.

As illustrated in FIG. 8, if a leading edge LE of each sheet of the sheet stack S is curled or burred by cutting, there is a relatively high adhesive force between the sheets at the leading edge LE thereof. If the uppermost sheet S1 attracted to the attraction belt 31 is curled or burred at the leading edge thereof and the attraction belt 31 is separated from the sheet stack S, the uppermost sheet S1 is likely to fall or separate from the attraction belt 31 due to the adhesive force exerted at the leading edge thereof.

To avoid separation of the uppermost sheet S1 from the attraction belt 31, the attraction belt 31 is rotated in reverse to convey the uppermost sheet 51 in a reverse direction opposite the sheet conveyance direction to as separate the leading edge of the uppermost sheet S1 and the leading edge of a second sheet that is a subsequent sheet of the sheet stack S, thereby eliminating the adhesive force between the uppermost sheet S1 and the second sheet. This action is hereinafter also referred to as a "pre-separation operation".

It is conceivable that the electrostatic attractive force is strong to a force in the sheet conveyance direction, and therefore, even if the uppermost sheet S1 is conveyed in the reverse direction, the uppermost sheet 51 can remain in contact with the attraction belt 31.

Further, the uppermost sheet S1 may be conveyed toward a pair of conveyance rollers 45 without being conveyed in reverse. In this case, however, the uppermost sheet S1 is likely to be caught by the leading edge LE of sheets of the sheet stack S, projected to the attraction belt 31 due to curl or bur formed after cutting. If the uppermost sheet S1 is caught by the leading edge LE of the sheet stack S, the sheet conveyance operation will slow down.

By contrast, the uppermost sheet S1 located upstream from the leading edge LE of the sheet stack S in the sheet conveyance direction is conveyed at a predetermined speed by the attraction belt 31. At this speed, a separation force is exerted from the attraction belt 31 to the uppermost sheet S1 attracted to an upstream area of the attraction belt 31 from the projecting leading edge LE of the sheet stack S, and therefore the uppermost sheet S1 can leave or separate from the attraction belt 31. Accordingly, if the uppermost sheet S1 is conveyed without performing a separating operation in which the uppermost sheet S1 is conveyed further forward while the uppermost sheet S1 is attracted to the attraction belt 31, it is likely that the sheet conveyance failure occurs.

In addition, a curl or burr formed after cutting can occur at a trailing edge TE of sheets of the sheet stack S as well as at the leading edge LE thereof, and thus the sheet stack S protrudes at the trailing edge TE. Consequently, when the uppermost sheet 51 is conveyed in the reverse direction, the uppermost sheet S1 can abut against and be caught by the trailing edge TE of the sheet stack S. However, in this present embodiment, the trailing edge TE of the sheet stack S and the sheet feeding device 30 are separated sufficiently, and therefore, even if the uppermost sheet S1 abuts against the trailing edge TE of the sheet stack S to be bent or warped, the uppermost sheet S1 can remain in contact with the attraction belt 31 without causing any adverse effect.

Further, in the present embodiment, the sheet attraction surface portion A of the attraction belt 31 is located upstream from the leading edge LE of the sheet stack S in the sheet conveyance direction. As illustrated in FIG. 8, if the protruding leading edge LE of the sheet stack S is bent or warped toward the attraction belt 31 due to curl or burr formed after cutting, when the sheet attraction surface portion A of the attraction belt 31 contacts the leading edge LE of the sheet stack S, a contact pressure at the leading edge LE of the sheet stack S with respect to the attraction belt 31 increases. Consequently, when the pre-separation operation is performed to convey the uppermost sheet S1 in reverse, it is likely that multiple sheets of the sheet stack S are also conveyed in reverse together with the uppermost sheet S1.

Therefore, to avoid multiple sheets being conveyed together with the uppermost sheet S1 in a reverse direction, the sheet attraction surface portion A of the attraction belt 31 is located upstream from the leading edge LE of the sheet stack S in the sheet conveyance direction so that the sheet attraction surface portion A does not contact the leading edge LE of the sheet stack S. By so doing, when the uppermost sheet S1 is conveyed in the reverse direction, multiple subsequent sheets can be prevented from being conveyed in the reverse direction together with the uppermost sheet S1.

Further, in the present embodiment, as illustrated in FIG. 8, the uppermost sheet S1 is conveyed in the reverse direction until the leading edge of the uppermost sheet S1 reaches an upstream side from a downstream end of the sheet attraction surface portion A of the attraction belt 31 in the sheet conveyance direction. By moving the uppermost sheet S1 to the upstream side from the attraction belt 31, the leading edge of the uppermost sheet S1 is sandwiched between the second sheet of the sheet stack S and the attraction belt 31. Accordingly, if the uppermost sheet S1 has a curl at the leading edge thereof, the curl can be decurled or corrected by application of pressure applied at the leading edge of the uppermost sheet S1 placed between the second sheet and the attraction belt 31. Similarly, even if the uppermost sheet S1 has been burred by cutting, the projecting burr toward the attraction belt 31 can be flattened or leveled. Owing to this correction, when the leading edge of the uppermost sheet S1 is conveyed to the pair of conveyance rollers 45, the uppermost sheet S1 does not be caught by the roller(s) of the pair of conveyance rollers 45, thereby preventing the sheet conveyance failure.

In this embodiment, as illustrated in FIG. 2, the width of the attraction belt 31 is greater than the width of sheets that can be accommodated in the sheet feeding cassette 15, and therefore the uppermost sheet S1 can be sandwiched between the attraction belt 31 and the second sheet of the sheet stack S across the entire width of the uppermost sheet 51. Consequently, a curl or burr formed after cutting at the leading edge of the uppermost sheet S1 can be corrected reliably.

Figure 9:
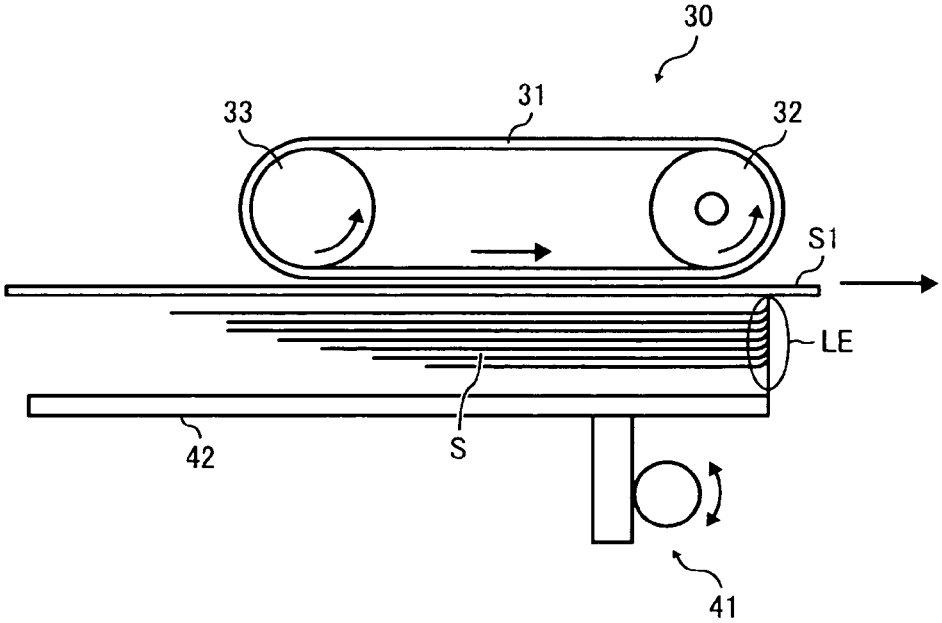
FIG. 9 is a drawing for explaining a sheet conveying operation of the sheet feeding device of FIG. 3.

As described above, after the uppermost sheet S1 is conveyed in the reverse direction until the leading edge of the uppermost sheet S1 reaches the upstream side from the downstream end of the sheet attraction surface portion A of the attraction belt 31 in the sheet conveyance direction, the sheet feeding device 30 performs the sheet separating operation in step S107. Specifically, the bottom plate 42 moves downward by a predetermined amount, and the uppermost sheet S1 attracted to the attraction belt 31 is separated from the sheet stack S, as illustrated in FIG. 9. This action is hereinafter also referred to as a "separating operation".

After the uppermost sheet S1 attracted to the attraction belt 31 is separated from the sheet stack S (i.e., after the separating operation is completed), the drive roller 32 is rotated in a forward direction to convey the uppermost sheet S1 attracted to the attraction belt 31 toward the pair of conveyance rollers 45 in step S108.

At this time, as illustrated in FIG. 9, the uppermost sheet S1 separate from the sheet stack S. In this state, the uppermost sheet S1 can be conveyed toward the pair of conveyance rollers 45 without abutting against the leading edge LE of the sheet stack S, projecting to the attraction belt 31 due to curl or burr formed after cutting. By so doing, the sheet can be conveyed in a stable condition. The linear velocity of the pair of conveyance rollers 45 is identical to the linear velocity of the attraction belt 31. If the pair of conveyance rollers 45 is driven intermittently at predetermined intervals, the attraction belt 31 is also driven intermittently. Further, after the uppermost sheet 51 has reached the pair of conveyance rollers 45, the driving of the attraction belt 31 is blocked to rotate the attraction belt 31 freely, and therefore the load of the drive motor 101 can be reduced.

Further, the charging of the attraction belt 31 may be performed only over the length from a position where the uppermost sheet S1 separates from the attraction belt 31 to the pair of conveyance rollers 45, and the attraction belt 31 may be thereafter electrically discharged by the charging member 34. With this configuration, the uppermost sheet S1 conveyed to the pair of conveyance rollers 45 is then conveyed solely by the conveyance force of the pair of conveyance rollers 45 with no influence from the attraction belt 31. Further, with the discharge of the attraction belt 31, the second sheet separated from the attraction belt 31 is prevented from being electrostatically attracted back to the attraction belt 31.

Figure 10A:
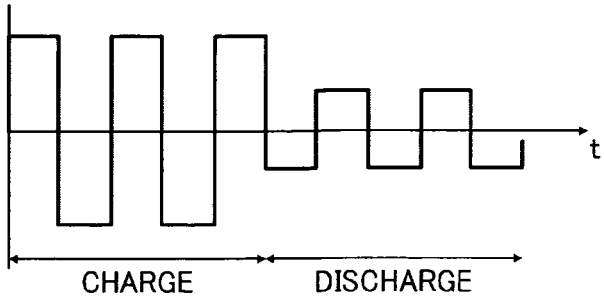
FIG. 10A is a schematic diagram illustrating square waves for charging and discharging a belt included in the sheet feeding device of FIG. 3.
Figure 10B:
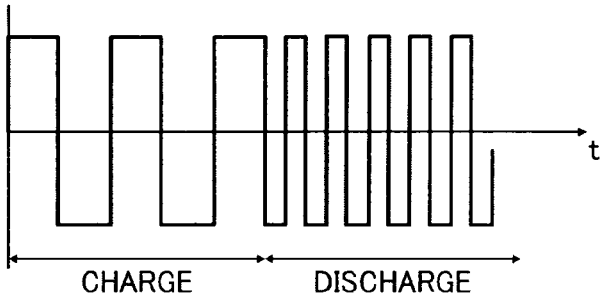
FIG. 10B is another schematic diagram illustrating square waves for charging and discharging a belt included in the sheet feeding device shown in FIG. 3.

FIGS. 10A through 10B show schematic diagrams illustrating waveforms for charging and discharging the attraction belt 31 while the attraction belt 31 is moving.

As illustrated in FIG. 10A, a voltage is controlled to charge and discharge the surface of the attraction belt 31. For example, the voltage applied by the charging member 34 may be decreased to remove the charge pattern formed on the surface of the attraction belt 31.

As illustrated in FIG. 10B, frequency of the charging member 34 may be increased to shorten the pitches of the charge pattern formed on the surface of the attraction belt 31. Thus, the force of attraction or the attractive force of the attraction belt 31 for attracting the uppermost sheet S1 may be decreased according to Maxwell stress.

Figure 10C:
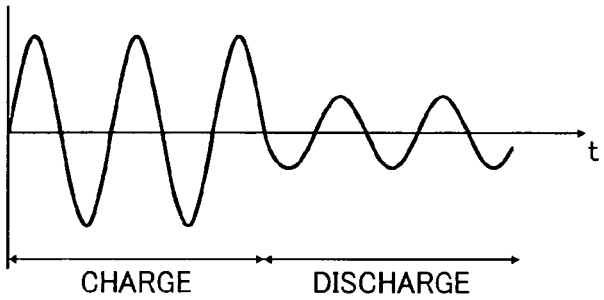
FIG. 10C is a schematic diagram illustrating sine waves for charging and discharging a belt included in the sheet feeding device shown in FIG. 3.
Figure 10D:
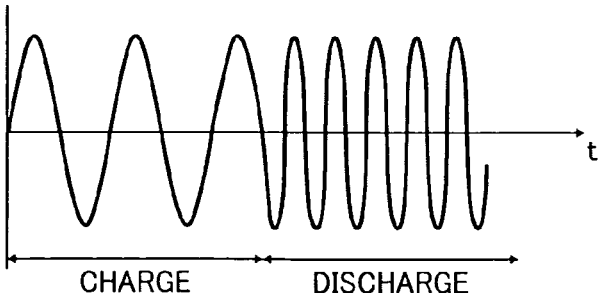
FIG. 10D is another schematic diagram illustrating sine waves for charging and discharging a belt included in the sheet feeding device shown in FIG. 3.

FIGS. 10A and 10B illustrate square waves formed by the direct current alternately applied. Similarly, the alternating current may be used. FIGS. 10C and 10D illustrate sine waves formed by the alternating current, which are used in an embodiment of the present invention.

Further, if paper dust and other foreign materials adhere to the attraction belt 31, the electrostatic attraction may be adversely affected. Therefore, a cleaning unit may be provided in the sheet feeding device 30 to clean the surface of the attraction belt 31 by removing the paper dust and other foreign materials adhering to the attraction belt 31.

[Variation]

Next, a description is given of a variation of the above-described embodiment.

Figure 11:
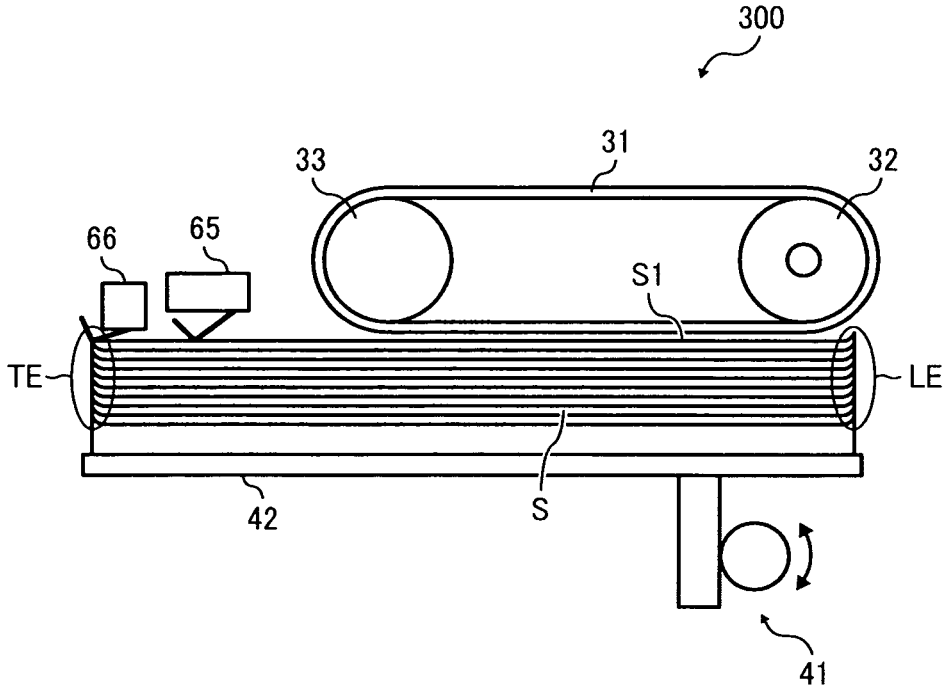
FIG. 11 illustrates a schematic diagram of a sheet feeding device according to an variation of the embodiment of the present invention.

FIG. 11 illustrates a schematic diagram of a sheet feeding device 300 according to a variation of the above-described embodiment of the present invention.

Elements and components of the sheet feeding device 300 according to this variation may be denoted by the same reference numerals as those of the sheet feeding device 30 according to the above-described embodiment, and the descriptions thereof are omitted or summarized.

As illustrated in FIG. 11, the sheet feeding device 300 has a similar configuration to the sheet feeding device 30, except that the sheet feeding device 300 further includes a curl detection unit 66 at a position facing the trailing edge TE of the sheet stack S. The sheet feeding device 300 according to this variation determines the number of reverse rotations of the attraction belt 31 in the pre-separation operation based on the detection results obtained by the curl detecting unit 66.

The position of the curl detection unit 66 is adjustable in a range along the sheet conveyance direction.

Figure 12:
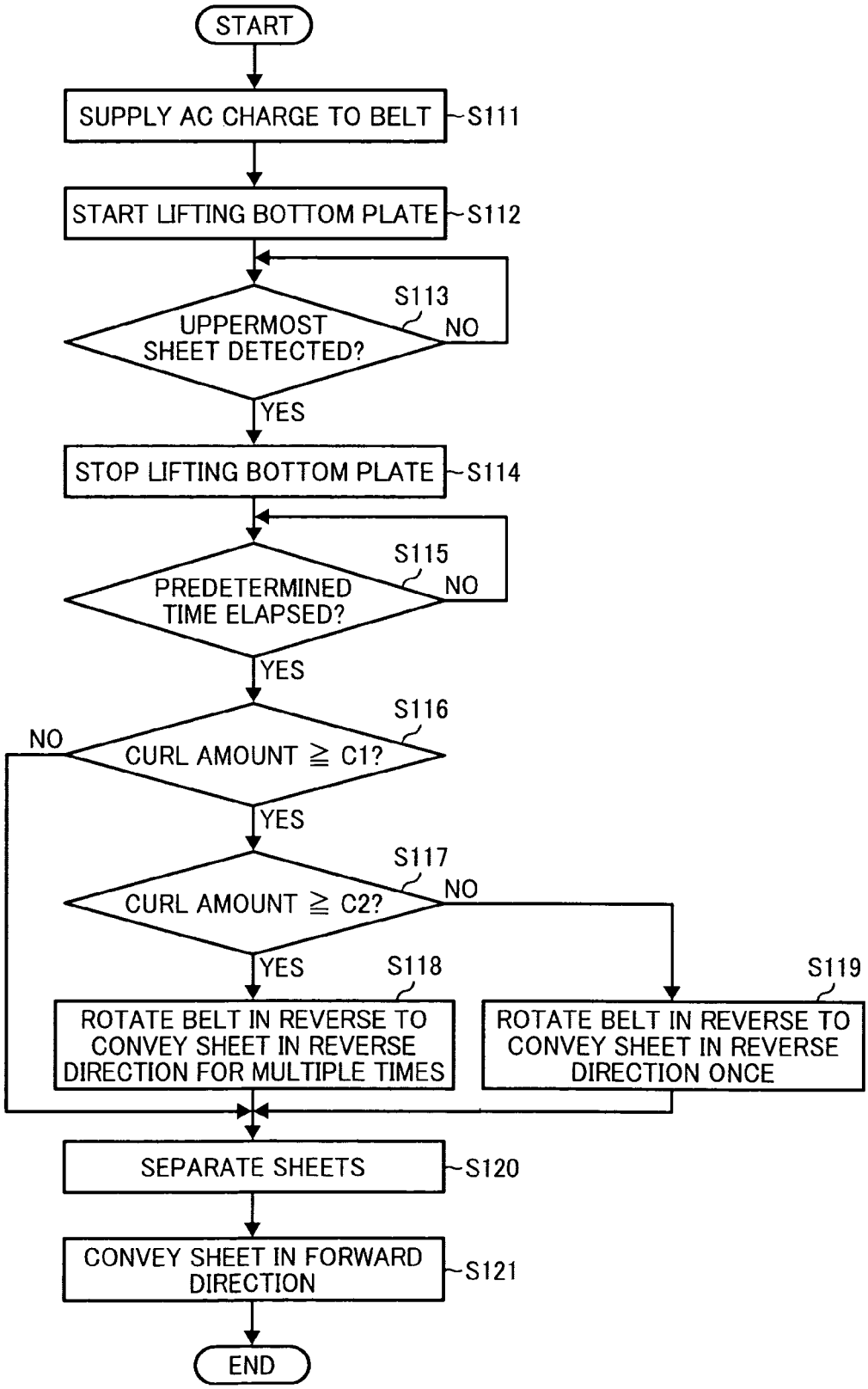
FIG. 12 is a flowchart of a sheet conveying operation performed by the sheet feeding device of FIG. 11.

FIG. 12 is a flowchart showing a sheet conveying operation of the sheet feeding device 300.

Steps S111 through S115 performed in the sheet conveying operation of the sheet feeding device 300 according to a variation of the present invention correspond to steps S101 through S105 performed in the sheet conveying operation of the sheet feeding device 30 according to an embodiment of the present invention, and therefore detailed descriptions of steps S111 through S115 are summarized. Namely, after the attraction belt 31 charged with an alternating-current voltage has been held in contact with the uppermost sheet S1 of the sheet stack S for the predetermined period of time (steps S111 through S115), the curl detection unit 66 detects whether the amount of curl of the sheet stack S equals or exceeds a first threshold C1 or the amount of curl thereof falls below the first threshold C1 in step S116. That is, the amount of curl of the sheet stack S including the uppermost sheet S1 is compared with the first threshold C1 in step S116.

When the amount of curl of the sheet stack S falls below the first threshold C1, the result of step S116 is NO, which indicates that the sheet stack S has no curl or substantially no curl at the leading edge LE thereof and the adhesive force between the leading edge of the uppermost sheet S1 and the leading edge of the second uppermost sheet is weak. Accordingly, the pre-separation operation in which the attraction belt 31 with the uppermost sheet S1 attracted thereto rotates in reverse to convey the uppermost sheet S1 in the reverse direction is not performed, and the procedure goes to step S120 to perform the separating operation. By performing the separating operation by skipping the pre-separation operation, the sheets accommodated in the sheet feeding cassette 15 can be conveyed to the pair of conveyance rollers 45 in a shorter period of time than by performing both the pre-separation operation and the separating operation.

After the uppermost sheet S1 attracted to the attraction belt 31 is separated from the sheet stack S, the drive roller 32 is rotated in a forward direction to convey the uppermost sheet S1 attracted to the attraction belt 31 toward the pair of conveyance rollers 45 in step S121.

By contrast, when the amount of curl of the sheet stack S equals or exceeds the first threshold C1, the result of step S116 is YES, which indicates that the adhesive force between the leading edge of the uppermost sheet S1 and the leading edge of the second uppermost sheet is strong. Therefore, it is needed to perform the pre-separation operation before the separating operation to eliminate the adhesive force between the leading edge of the uppermost sheet S1 and the leading edge of the second uppermost sheet by rotating the attraction belt 31 in reverse.

Thereafter, the curl detection unit 66 detects whether the amount of curl of the sheet stack S equals or exceeds a second threshold C2 or the amount of curl thereof falls below the second threshold C1 in step S117. That is, the amount of curl of the sheet stack S including the uppermost sheet S1 is compared with the second threshold C2 in step S117.

When the amount of curl of the sheet stack S falls below the second threshold C2, the result of step S117 is NO, which indicates that the sheet stack S has curl but not severely affected to the separating operation. Therefore, it is likely that the curl formed at the leading edge of the uppermost sheet S1 can be corrected after the leading edge of the uppermost sheet S1 is sandwiched with pressure between the attraction belt 31 and the second uppermost sheet once. As a result, when the amount of curl of the sheet stack S equals or exceeds the first threshold C1 (YES of step S116) and falls below the second threshold C2 (NO of step S117), the pre-separation operation is performed once before the separating operation (in steps S119 and S120). The above-described determination can prevent the leading edge of the uppermost sheet S1 from being caught by the pair of conveyance rollers 45 during the sheet conveyance operation. Accordingly, the sheets of the sheet stack S can be conveyed reliably.

After the separating operation in step S120, the drive roller 32 is rotated in the forward direction to convey the uppermost sheet S1 attracted to the attraction belt 31 toward the pair of conveyance rollers 45 in step S121.

By contrast, when the amount of curl of the sheet stack S equals or exceeds the second threshold C2, the result of step S117 is YES, which indicates that the amount of curl thereof is large and therefore the curl at the leading edge of the uppermost sheet S1 cannot be corrected with an only one pre-separation operation before the separating operation. Therefore, when the amount of curl of the sheet stack S equals or exceeds the second threshold C2, it is needed to perform the pre-separation operation for multiple times before the separating operation.

Specifically, after the pre-separation operation is performed once, the drive roller 32 is rotated in the forward direction, and then is stopped at the moment that the leading edge of the uppermost sheet S1 reaches the leading edge LE of the sheet stack S. If the uppermost sheet S1 is further conveyed toward the pair of conveyance rollers 45, the uppermost sheet S1 may be caught by the leading edge LE of the sheet stack S, which can cause the uppermost sheet S1 to be separated from the attraction belt 31. When the leading edge of the uppermost sheet S1 reaches the leading edge LE of the sheet stack S, the drive roller 32 is rotated in reverse so as to convey the uppermost sheet S1 in the reverse direction.

By performing the pre-separation operation for multiple times, the curl formed at the leading edge of the uppermost sheet S1 can be corrected gradually until the curled leading edge thereof cannot be caught by the pair of conveyance rollers 45. At this time, the separating operation is performed in step S120. Therefore, even if the uppermost sheet S1 has a large amount of curl at the leading edge thereof, the curl can be corrected by performing the pre-separation operation more than two times to prevent the leading edge of the uppermost sheet S1 from being caught by the pair of conveyance rollers 45 during the sheet conveyance operation. Accordingly, the sheets of the sheet stack S can be conveyed reliably.

After step S120, the uppermost sheet 51 attracted to the attraction belt 31 is conveyed toward the pair of conveyance rollers 45 in step S121.

Thus, the sheet feeding device 300 according to the above-described variation can convey the sheets accommodated in the sheet feeding cassette 15 in a short period of time toward the pair of conveyance rollers 45 and can convey the sheets stably and reliably.

In the above-described embodiment, the sheet feeding device 30 includes the attraction belt 31 having the surface that is charged from outside, but is not limited thereto. For example, instead of the attraction belt 31, an attraction belt 233 that has a structure as shown in FIG. 13 can be employed in the sheet feeding device 30, 30A or 300.

Figure 13:
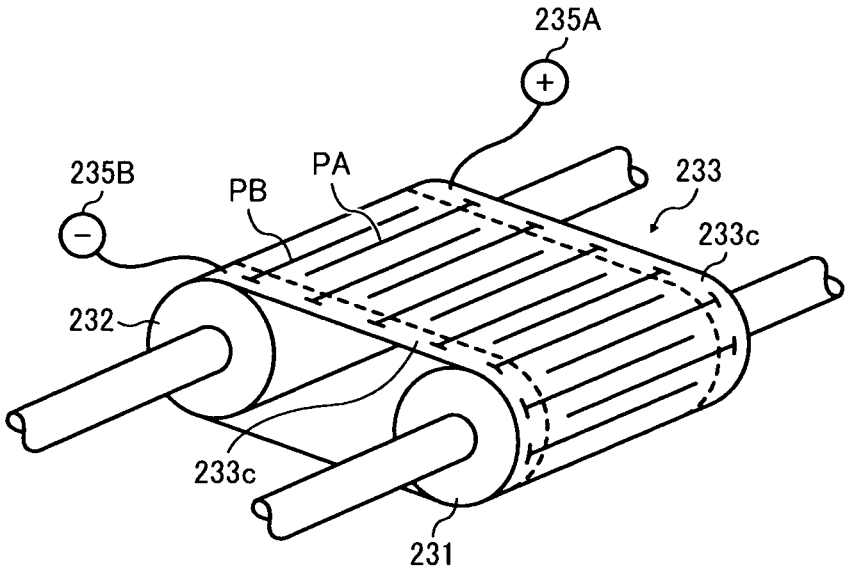
FIG. 13 is a diagram for explaining an example of another attraction unit.

FIG. 13 is a perspective view of an attraction belt 233 that is wound around a drive roller 231 and a driven roller 232. The attraction belt 233 has a surface on or inside which a comb-shaped positive potential holding section PA and a comb-shaped negative potential holding section PB are arranged alternately in the sheet feeding direction on the surface of the dielectric belt 233. An alternating current (AC) power supply 235A applies a positive voltage to the positive potential holding section PA and an alternating current (AC) power supply 235B applies a negative voltage to the negative potential holding section PB. The AC power supplies 235A and 235B serve as respective sheet attraction units. Power receiving portions 233*c* are exposed on edges in the width direction of the attraction belt 233 on the surface of the attraction belt 233 to receive the voltage applied from the AC power supplies 235A and 235B through the power receiving portions 233*c* to the positive potential holding section PA and the negative potential holding section PB. As long as the number of positive potential holding sections PA and the number of negative potential holding sections P formed on the surface of the attraction belt 233 contacting the uppermost sheet S1 of the sheet stack S are equal, this structure of the attraction belt 233 that can be employed in the sheet feeding device 30, 30A or 300 can achieve the same effect as the structure of the attraction belt 31 of the sheet feeding device 30.

Further, the uppermost sheet S1 of the sheet stack S is electrostatically attracted to the attraction belt 31 in the sheet feeding device 30, 30A or 300, but is not limited thereto. For example, the uppermost sheet S1 of the sheet stack S can be attracted to the attraction belt 31 by using an air attraction method.

Further, the sheet feeding device 30, 30A or 300 includes the sheet push-up unit 41 serving as the contact and separation unit to move upward and downward to contact or separate the sheet stack S with respect to the attraction belt 31, but is not limited thereto. For example, the sheet feeding device 30, 30A or 300 can have a configuration in which the attraction belt 31 swings or moves upward and downward to contact or separate from the sheet stack S.

As described above, the sheet feeding device 30 (hereinafter, the sheet feeding device 30 is referred to include the function of the sheet feeding device 30A) according to an embodiment of the present invention includes the attraction belt 31, the charging member 34, the AC power supply 38, the sheet push-up unit 41, and the controller 100. The attraction belt 31 that serves as an endless belt member is disposed facing the upper surface of the sheet stack S accommodated in the sheet cassette 15. The charging member 34 and the AC power supply 38 form a sheet attraction unit to attract the uppermost sheet S1 of the sheet stack S to the attraction belt 31. The sheet push-up unit 41 serves as a contact and separation unit to respectively contact and separate the attraction belt 31 relative to the sheet stack S. The controller 100 causes the attraction belt 31 of the sheet feeding device 30 to contact or substantially contact the upper surface of the sheet stack S so that the uppermost sheet 51 of the sheet stack S can be attracted to the attraction belt 31. Thereafter, the pre-separation operation is performed to move the attraction belt 31 with the uppermost sheet S1 attracted to the surface thereof in a reverse direction that is opposite the forward direction of rotation of the attraction belt 31, and then the separating operation is performed to separate the attraction belt 31 from the sheet stack S. As previously described, by performing the above-described pre-separation operation, the adhesion between the leading edge of the uppermost sheet S1 and the leading edge of the second uppermost sheet can be eliminated. Consequently, when the attraction belt 31 with the uppermost sheet S1 attracted thereto is separated from the sheet stack S, the uppermost sheet S1 can remain attracted to the attraction belt 31 reliably without being separated therefrom.

Further, in the sheet feeding device 30 according to an embodiment of the present invention, the sheet attraction surface portion A of the attraction belt 31 is arranged facing the upper surface of the sheet stack S to attract the uppermost sheet S1 thereto. The downstream end in the sheet conveyance direction of the sheet attraction surface portion A of the attraction belt 31 to which the uppermost sheet S1 of the sheet stack S is attracted is located upstream from the leading edge LE of the sheet stack S in the sheet conveyance direction. According to this configuration, when the uppermost sheet S1 is attracted to the attraction belt 31, the leading edge LE of the sheet stack S cannot contact the attraction belt 31.

In a case in which the sheet attraction surface portion A of the attraction belt 31 contacts the leading edge LE of the sheet stack S, if the leading edge LE of the sheet stack S is curled or burred by cutting, the contact pressure at the leading edge LE of the sheet stack S with respect to the attraction belt 31 increases. Consequently, when the uppermost sheet S1 is conveyed in the reverse direction, it is likely that multiple sheets are conveyed together with the uppermost sheet S1 due to the high contact pressure of the leading edge LE of the sheet stack S with respect to the attraction belt 31.

By contrast, in the sheet feeding device 30 according to an embodiment of the present invention, when the uppermost sheet S1 is attracted to the attraction belt 31, the leading edge LE of the sheet stack S will not contact the attraction belt 31, thereby avoiding occurrence of the high contact pressure of the sheet stack S with respect to the attraction belt 31. Accordingly, when the uppermost sheet S1 is conveyed in the reverse direction, the sheet feeding device 30 can avoid feeding multiple sheets of the sheet stack S together with the uppermost sheet S1.

Further, the controller 100 performs the pre-separation operation to cause the attraction belt 31 to rotate in the reverse direction that is a direction opposite to the moving direction of the surface of the attraction belt 31 for sheet feeding until the leading edge of the uppermost sheet S1 attracted to the attraction belt 31 reaches the upstream side from the downstream end of the sheet attraction surface portion A of the attraction belt 31 in the sheet conveyance direction. By so doing, the leading edge of the uppermost sheet S1 is sandwiched between the second uppermost sheet of the sheet stack S and the attraction belt 31. Consequently, when the uppermost sheet S1 has a curl at the leading edge thereof, the curl can be decurled or corrected. Alternatively, when the leading edge of the uppermost sheet S1 has been burred by cutting, the burr projecting toward the attraction belt 31 can be leveled in the sheet conveyance direction. Accordingly, the leading edge of the uppermost sheet S1 can be prevented from being caught by the pair of conveyance rollers 45, thereby conveying the uppermost sheet S1 stably and reliably.

Further, the sheet feeding device 300 according to the variation of the present invention includes the curl detection unit 66 facing the trailing edge TE of the sheet stack S and operatively connected to the controller 100 to detect the amount of curl of the sheet stack S. Based on the detection results obtained by the curl detecting unit 66, the controller 100 determines whether or not the pre-separation operation in which the attraction belt 31 with the uppermost sheet S1 attracted thereto is moved in the reverse direction is performed.

When the leading edge LE of the sheet stack S has no curl or substantially no curl, the adhesive force between the leading edge of the uppermost sheet S1 and the leading edge of the second uppermost sheet is weak. Therefore, after the uppermost sheet S1 is attracted to the attraction belt 31, even if the pre-separation operation is not performed, the uppermost sheet S1 cannot be separated from the attraction belt 31. Accordingly, when the detection results obtained by the curl detection unit 66 show that the amount of curl of the sheet stack S is less than or falls below the first threshold C1, the pre-separation operation is not performed. By skipping the pre-separation operation, the period of time from the receipt of the sheet feeding signal to the start of conveyance of the uppermost sheet S1 can be reduced.

By contrast, when the amount of curl of the sheet stack S equals or exceeds the first threshold C1, the adhesive force between the leading edge of the uppermost sheet S1 and the leading edge of the second uppermost sheet is strong. Therefore, the pre-separation operation is performed to remove or eliminate the adhesive force between the leading edge of the uppermost sheet S1 and the leading edge of the second uppermost sheet before the separating operation. By performing both the pre-separation operation and the separating operation, the uppermost sheet S1 cannot be separated from the attraction belt 31 during the separating operation.

Further, when the amount of curl of the sheet stack S equals or exceeds the second threshold C2 that is a predetermined value, it is needed to perform the pre-separation operation twice or more before the separating operation. When the amount of curl of the sheet stack S is greater than the second threshold C2 and the amount of curl of the uppermost sheet S1 is large, the pre-separation operation is performed more than once, so that the curl on the leading edge of the uppermost sheet S1 can be decurled or corrected up to a level in which the curled leading edge of the uppermost sheet S1 cannot be caught by the pair of conveyance rollers 45. Accordingly, the uppermost sheet S1 can be conveyed reliably.

A width along an axial direction of the attraction belt 31 is greater than a maximum width of any sheet that can be loaded in the sheet feeding cassette 15. Accordingly, the curl formed at the leading edge of the uppermost sheet S1 can be corrected successfully.

Further, the sheet attraction unit composed of the charging member 34 and the AC power supply 38 functions as an electric pattern forming unit to apply an alternating-current voltage to the attraction belt 31, and therefore can cause the uppermost sheet S1 to be attracted to the attraction belt 31 electrostatically.

Further, with being held in contact with the uppermost sheet S1 of the sheet stack S, the attraction belt 31 waits until a predetermined period of time elapses. With this action, only the uppermost sheet S1 can be attracted to the attraction belt 31 and, when the uppermost sheet S1 is conveyed in the reverse direction, other sheets of the sheet stack S cannot be conveyed together with the uppermost sheet S1.

Further, the sheet feeding device 30 employing an electrostatic sheet separation method can be made more compact with less noise when compared with a sheet feeding unit employing a sheet separation method with air. Specifically, the sheet feeding device with an air attraction method requires at least one air suction blower and at least one air duct to attract the uppermost sheet S1 to the attraction belt 31 and generates air suction noise, and therefore the sheet feeding device 30 using the electrostatic sheet separation method can reduce the size and noise.

Further, the sheet feeding device 30 is incorporated in the image forming apparatus (the copier) 10, thereby conveying sheets stably and reliably.

Further, the controller 100 provided in the image forming apparatus 10 controls movement of the surface of the attraction belt 31 of the sheet feeding device 30. Therefore, compared with a configuration in which a controller for the image forming apparatus 100 and another controller for the sheet feeding device 30 are provided separately, the image forming apparatus 100 can be formed at lower costs.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet feeding device, comprising:

an endless belt disposed facing an upper surface of a sheet stack to convey sheets of the sheet stack forward in a first moving direction;

an attraction unit to attract an uppermost sheet of the sheet stack to the endless belt;

a contact and separation unit to contact and separate the endless belt relative to the sheet stack; and a controller to cause the endless belt to:

contact or substantially contact the upper surface of the sheet stack to attract the uppermost sheet to the endless belt;

rotate the endless belt in reverse to convey the uppermost sheet attracted thereto in a second moving direction opposite the first moving direction; and separate the endless belt from the sheet stack.

2. The sheet feeding device according to claim 1, wherein the endless belt includes a sheet attraction surface portion arranged facing the upper surface of the sheet stack to attract the uppermost sheet thereto, wherein a downstream end of the sheet attraction surface portion of the endless belt in a sheet conveyance direction is located upstream from a leading edge of the sheet stack in the sheet conveyance direction.

3. The sheet feeding device according to claim 2, wherein the controller causes the endless belt to move in the second moving direction until a leading edge of the uppermost sheet attracted to the endless belt comes to a point upstream from the downstream end of the sheet attraction surface portion of the endless belt in the sheet conveyance direction.

4. The sheet feeding device according to claim 3, further comprising a curl detector facing a trailing edge of the sheet stack and operatively connected to the controller to detect an amount of curl of the sheet stack, wherein the controller determines, based on detection results obtained by the curl detector, whether or not the endless belt with the uppermost sheet attracted thereto is moved in the second moving direction.

5. The sheet feeding device according to claim 4, wherein, when the amount of curl of the sheet equals or exceeds a threshold amount, the controller causes the endless belt to move in the second moving direction multiple times.

6. The sheet feeding device according to claim 1, wherein a width of the endless belt is greater than a maximum width of the sheet stack that can be accommodated in a sheet container.

7. The sheet feeding device according to claim 1, wherein the attraction unit applies an alternating electrical charge to the endless belt.

8. An image forming apparatus, comprising:

an image forming unit to form an image on a recording medium; and the sheet feeding device according to claim 1.

9. The sheet feeding device according to claim 1, wherein the controller causes the endless belt to separate the uppermost sheet away from the sheet stack and convey the uppermost sheet downstream in the first moving direction.

10. A sheet conveying method, comprising:

supplying an alternating charge to an endless belt;

moving a contact and separation unit upward for lifting a bottom plate;

detecting an uppermost sheet upon or immediately before contact of the uppermost sheet to the endless belt as the contact and separation unit moves upward;

stopping the contact and separation unit;

holding the endless belt in contact with the uppermost sheet until a predetermined period of time elapses;

rotating the endless belt in reverse to convey the uppermost sheet in a reverse direction opposite a sheet conveyance direction;

separating the uppermost sheet from the endless belt; and conveying the uppermost sheet attracted to the endless belt further forward.

11. The sheet conveying method according to claim 10, wherein the rotating comprises:

comparing an amount of curl of the uppermost sheet with a first threshold; and rotating the endless belt in a reverse direction that is opposite the sheet conveyance direction once when the amount of curl of the uppermost sheet equals or exceeds the first threshold.

12. The sheet conveying method according to claim 11, wherein the comparing comprises:

comparing the amount of curl of the uppermost sheet with a second threshold; and rotating the endless belt in the reverse direction for multiple times when the amount of curl of the uppermost sheet equals or exceeds the second threshold.

* * * * *